US005927816A

United States Patent [19]

Hsu

[11] Patent Number: 5,927,816

[45] Date of Patent: Jul. 27, 1999

[54] COLLAPSIBLE SAFE ROCKING CHAIR

[76] Inventor: Kevin Hsu, P.O. Box 90, Taiwan, Taiwan

[21] Appl. No.: 09/144,442

[22] Filed: Sep. 1, 1998

[51] Int. Cl.[6] ..... A47C 4/02

[52] U.S. Cl. ..... 297/440.13; 297/270.5; 297/271.6; 472/100; 472/102

[58] Field of Search ..... 297/440.13, 271.5, 297/271.6, 270.3, 270.5, 270.1; 472/95, 100, 102

[56] References Cited

U.S. PATENT DOCUMENTS

| | | | |
|---|---|---|---|
| D. 42,374 | 3/1912 | Pressler | 297/271.5 X |
| 947,579 | 1/1910 | Pressler | 297/271.6 X |
| 1,352,836 | 9/1920 | Runne | 297/270.3 |
| 2,551,071 | 5/1951 | Tyng | 297/271.5 X |
| 2,658,753 | 11/1953 | Dawson | 297/271.5 X |
| 2,755,087 | 7/1956 | Michels | 472/102 |
| 3,680,857 | 8/1972 | Bovicini et al. | 472/100 |
| 5,551,748 | 9/1996 | McKelvey et al. | 297/440.13 X |

FOREIGN PATENT DOCUMENTS

| | | | |
|---|---|---|---|
| 2457773 | 6/1976 | Germany | 472/102 |

*Primary Examiner*—Peter M. Cuomo
*Assistant Examiner*—David E. Allred

[57] ABSTRACT

A collapsible safe rocking chair includes a main body, two step plates, two rocking plates, a supporter, a seat, and a grip. All the components are made of foam material to make the rocking chair safe to use by children. The two step plates are releasably combined under the main body for two feet to step on, and the two rocking plates are releasably combined under the two step plates to make the chair rock on the ground. The seat is releasably combined on the supporter and on the main body for a child to sit on, with the grip releasably combined on a front end portion of the main body for a user to grip with two hands.

3 Claims, 2 Drawing Sheets

COLLAPSIBLE SAFE ROCKING CHAIR

BACKGROUND OF THE INVENTION

This invention relates to a collapsible safe rocking chair, particularly to one made of foam material to enhance its safety in using, having components that are easily combined and collapsible for convenience of packing, storing and transporting.

Conventional rocking chairs for children are generally made to have an animal shape or cartoon figures, made of wood, metal, or hard plastic, and are not collapsible. So they have rather large dimensions for packing, storing and transporting, resulting in a large storing space, high cost in packing and transporting. In addition, they are made of hard materials, easily hurting children during playing on them.

SUMMARY OF THE INVENTION

The main purpose of the invention is to offer a a collapsible safe rocking chair exclusively for children, that is light, very safe to play, and easy to assemble and collapse.

The main feature of the invention is a main body of a plate shape, two step plates combined releasably under the main body laterally, two rocking plates combined releasalby under the two step plates in parallel to the main body for rocking on the ground, a seat deposited releasably on a supporter fitted on the main body and on the main body for a user (child) to sit on, a grip releasably combined in a front end portion of the main body, and having an easily collapsible structure.

Another feature of the invention is that all the components are made of foam material, making the rocking chair very safe to use.

BRIEF DESCRIPTION OF DRAWINGS

This invention will be better understood by referring to the accompanying drawings, wherein.

DETAILED DESCRIPTION OF THE PREFERRED EMBODIMENT

Figure 1:
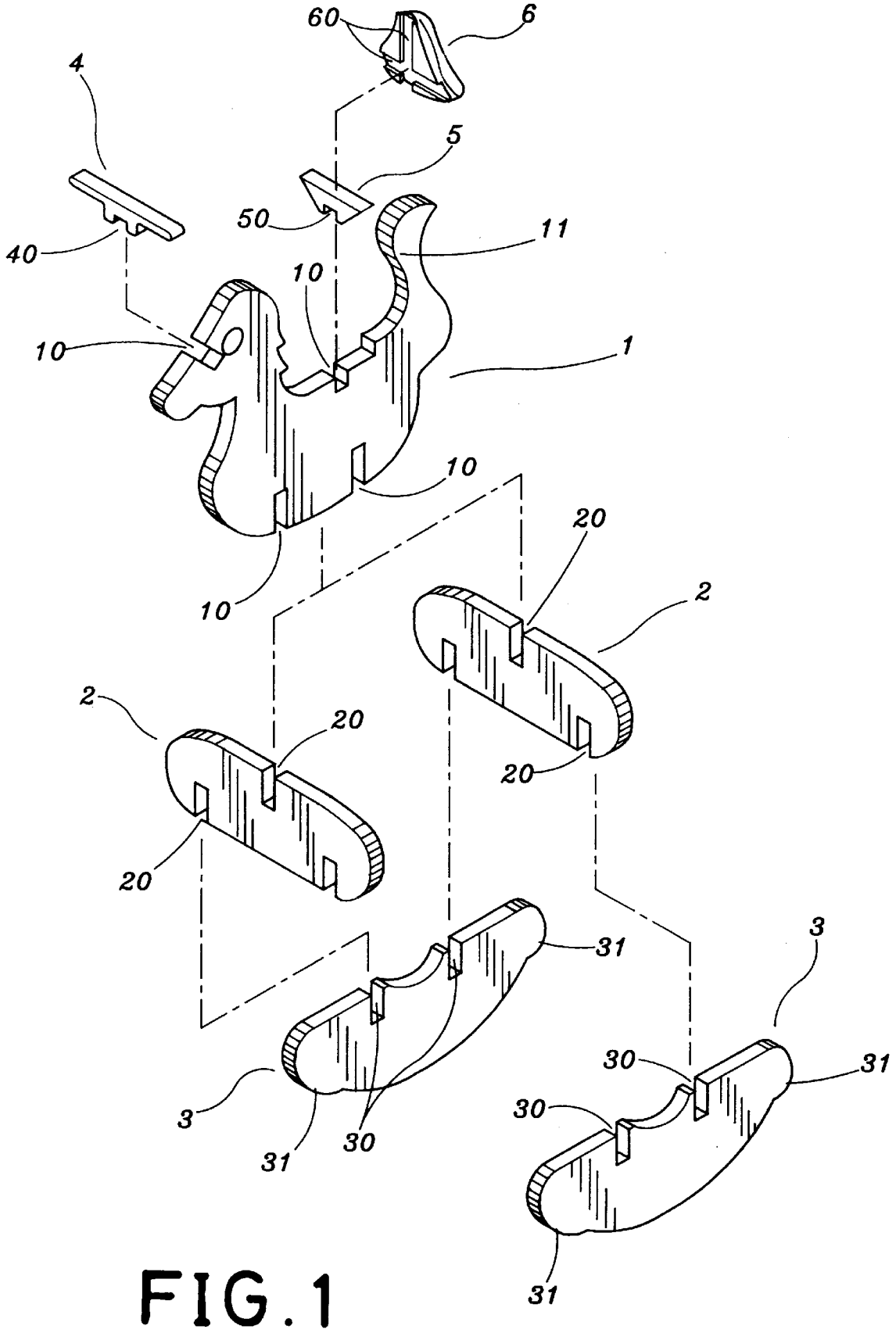
FIG. 1 is an exploded perspective view of a collapsible safe rocking chair in the present invention; and, FIG. 2 is a perspective view of the collapsible safe rocking chair in the present invention.

A preferred embodiment of a collapsible safe rocking chair of the present invention, as shown in FIG. 1, includes a main body 1, two step plates 2, two rocking plates 3, a grip 4, a supporter 5 and a seat 6 as components collapsibly combined together. All the components are made of foam material.

The main body 1 is shaped as an animal, a cartoon figure or any geometrical shape, having a fitting groove 10 respectively in a front portion, an intermediate portion and a lower portion, and back rest 11 formed in a rear end portion.

The two connect plates 2 is shaped nearly oval combined under the main body 1, having a notch 20 in an upper side and two notches spaced apart properly in a lower side.

The two rocking plates 3 combine under the two connect plates 2, respectively having a curved lower side for rocking, two notches 30 spaced apart in an upper side to fit with the two notches 20 in the lower side of the two connect plates 2, a curved stop 31 formed respectively in a front end and a rear end.

The grip 4 is combined with an front portion of the main body 1, having a notch 40 in a lower side to fit with the notch 10 in the front portion of the main body 1.

The supporter 5 is shaped trapizoid and having an upper flat surface, and a notch 50 in a lower side to fit with the notch 10 in the intermediate portion of the main body.

The seat 6 is provided with a nearly cross-shaped groove 60 formed in a lower side to be mounted on the supporter 5 and on the intermediate portion of the main body 1.

Figure 2:
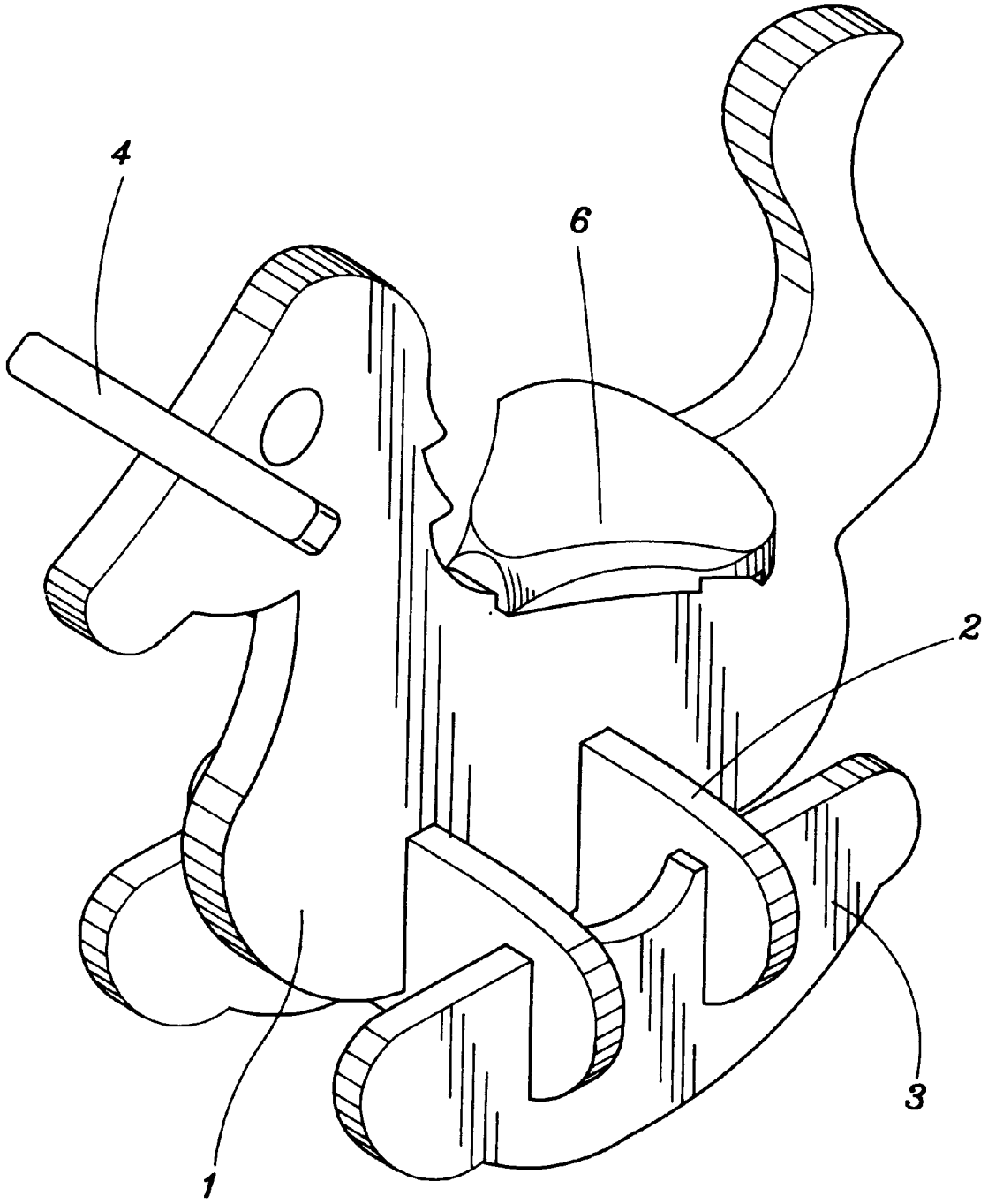

In assembling, referring to FIGS. 1 and 2, firstly the two connect plates 2 are combined vertically and laterally with the main body 1 in a right angle, with the upper notches 20 of the two connect plates 2 fitting with the two lower notches 10 of the main body 1. Then the rocking plates 3 are combined with the two connect plates 2 in parallel to the main body 1, with the two notches 30 fitting with the two lower notches 20 of the connect plates 2. Next, the grip 4 and the supporter 5 are respectively combined with the main body 1, with the notch 40 of the grip 4 fitting with the front notch 1 of the main body 1 and with the notch 50 of the supporter 5 fitting with the middle notch 10 of the main body 1. Finally the seat 6 is forcefully pushed on the main body 1 and on the supporter 5, with the cross-groove 60 of the seat 6 fitting firmly with the main body 1 and the supporter 6.

In using, a user holds the grip 4 with two hands, and steps on the step plates 2 with two feet, rests on the back rest 11 with the back, swings the main body back and forth, with the two stops 31 able to prevent the main body 1 from swinging too large and from the user from falling off or harm, accident, etc.

As can be seen from the description, the collapsible safe rocking chair in the invention has the following advantages:

1. It is collapsible to lessen the dimensions for packing, storing and transporting, thus reducing cost.

2. It is made of foam material, augmenting its stability, lessening its weight, preventing users (children) from getting hurt, and enhancing safety.

3. It is easy to collapse and, convenient for carrying and storing.

While the preferred embodiment of the invention has been described above, it will be recognized and understood that various modifications may be made thereto and the appended claims are intended to cover all such modifications which may fall within the spirit and scope of the invention.

What is claimed is:

1. A collapsible safe rocking chair comprising:

a main body of a planar shape, said main body having a notch extending transversely through said body respectively in a plurality of locations;

two parallel step plates of an oval shape under said main body, respectively having an upper notch in an upper side releasably fitting with two lower notches of said main body, each step plate having two lower notches spaced apart in a lower side and releasably fitting with two notches of two respective parallel rocking plates extending perpendicular to and positioned under said step plates;

said two rocking plates defining vertical planes parallel and spaced laterally relative to said main body and releasably attached to said two step plates, respectively having said two notches spaced apart in an upper side to releasably fit with said two lower notches of said two step plates, a curved edge respectively formed in a lower end of said rocking plates for rocking, and a curved stop surface respectively formed in a front end and a rear end of each lower end for stopping said chair in rocking movement;

a grip connected with a front end portion of said main body, said grip having a notch formed in a lower surface to fit with a front notch of said main body for a user to grip with two hands in rocking:

a trapezoidal-shaped supporter having a notch in a lower surface to fit with an upper notch of said main body for securing a seat with said main body;

said seat having a substantially cross-shaped groove formed in a lower surface to fit with an upper edge of said main body and on said supporter; and said collapsible safe rocking chair being easy to assemble and collapse, convenient to carry, store and transport when collapsed, and having stability to prevent users from getting hurt.

2. The collapsible safe rocking chair as claimed in claim 1, wherein the components of said collapsible safe rocking chair are all made of foam material.

3. The collapsible safe rocking chair as claimed in claim 1, wherein a back rest is further formed in a rear end portion of said main body.

* * * * *